United States Patent [19]

Ambrose

[11] 4,036,364

[45] July 19, 1977

[54] UNITIZED PALLETLESS LOAD AND METHOD OF FORMING SAME

[75] Inventor: Everett J. Ambrose, Simsbury, Conn.

[73] Assignee: Monsanto Company, St. Louis, Mo.

[21] Appl. No.: 674,753

[22] Filed: Apr. 8, 1976

[51] Int. Cl.[2] ..... B65D 85/16; B65D 63/00

[52] U.S. Cl. ..... 206/526; 206/83.5; 206/386; 206/497; 214/10.5 R; 217/66

[58] Field of Search ..... 214/10.5 R; 206/322, 206/83.5, 497, 526, 386; 217/66, 67, 68

[56] References Cited

U.S. PATENT DOCUMENTS

| | | | |
|---|---|---|---|
| 2,489,054 | 11/1949 | Sprolle | 206/386 |
| 3,077,982 | 2/1963 | Berner | 206/386 |
| 3,231,084 | 1/1966 | Kean, Sr. | 217/66 |
| 3,247,958 | 4/1966 | Dreher | 206/322 |
| 3,385,678 | 5/1968 | Sorenson | 29/187 |
| 3,589,510 | 6/1971 | Begnaud | 206/497 |
| 3,695,426 | 10/1972 | Engelsberger | 214/10.5 R |
| 3,788,462 | 1/1974 | Meincer | 206/497 |
| 3,788,462 | 1/1974 | Meincer | 206/655 |
| 3,809,223 | 5/1974 | Kendall | 206/497 |
| 3,853,218 | 12/1974 | Grasvoll | 206/497 |
| 3,884,935 | 5/1975 | Burns | 206/322 |
| 3,906,591 | 9/1975 | Boiardi | 217/66 |

OTHER PUBLICATIONS

Equipment Newsletter, 3/1976, p. 119, Modern Materials Handling.

*Primary Examiner*—Stephen P. Garbe
*Assistant Examiner*—Bruce H. Bernstein
*Attorney, Agent, or Firm*—Michael J. Murphy

[57] ABSTRACT

In a palletless load unit which includes vertically stacked layers, each of which contains plural articles, the improvement comprising a strap member perimetrically disposed locally and compressively engaging outer articles in the lowermost layer to create a substantially rigid support for the remaining layers. The method involves applying a strap tightly around the girth of the lower layer to establish the latter as the unitized support for the load during transfer movement between adjacent stacking and unitizing stations.

4 Claims, 3 Drawing Figures

UNITIZED PALLETLESS LOAD AND METHOD OF FORMING SAME

BACKGROUND OF THE INVENTION

This invention relates to bulk packaging and more particularly to bulk packaging improvements directed toward elimination of a pallet support or like means.

In large volume, automated, secondary packaging installations, it is conventional to unite groups of articles such as containers in boxes or cartons at a charging station, then transfer such loaded cartons to a stacking station where they are grouped in layers and piled vertically on a pallet or other support, and then to convey the supported load to an adjacent load-unitizing station where, for example, a thin film envelope is shrunk about the plural layers to form a unitized load. In such an environment, the support for the stacked cartons serves to stabilize and hold the load together during conveying between the stacking and load-unitizing stations, as well as during any lifting movement where a change of elevation may be involved. Of course, as is known, the encapsulating film can be shrunk around the pallet also when the latter is the support for the load and such palleted, shrunk-wrapped unit forms the product to be shipped to a customer. However, as set forth in U.S. Pat. No. 3,788,462, a palletless load has many advantages, perhaps the most significant being the marked reduction in the rather substantial cost of load-stabilizing materials. In addition, though loads of the type described in such patent are shipped without a pallet, it appears that a pallet or other means of support is nevertheless required for the load before and during shrink-wrapping.

SUMMARY OF THE INVENTION

Now, however, palletless load improvements have been developed which eliminate the need for using any special auxilliary support member at all for the load either during its assembly or thereafter.

Accordingly, it is a principal object of this invention to provide an improved palletless load unit.

Another object is to provide a process improvement for simplifying and significantly reducing the cost of handling stacked layers of articles in a large volume, bulk packaging installation.

An additional object is to convert the lower layer of a stack of plural layers into the means for supporting the layers above the lower one.

A further object is to provide bulk packaging improvements which provide a significant cost savings and which are particularly applicable to lightweight plastic containers.

Other objects of this invention will in part be obvious and will in part appear hereinafter from the following description and claims.

These and other objects are accomplished in a palletless load unit which includes vertically stacked layers, each containing plural articles, by providing the improvement comprising strapping means locally perimetrically disposed around the lowermost layer and compressively engaging outer articles therein to unitize such lowermost layer.

Also provided in the process of transferring a load of layered articles between adjacent stacking and load-unitizing stations is the step comprising applying a strap tightly around the girth of the lowermost layer after stacking thereby establishing such lowermost layer as a unitized support for the remainder of the load during such transfer.

BRIEF DESCRIPTION OF THE DRAWINGS

In describing the invention, reference will be made to the accompanying drawings wherein.

DETAILED DESCRIPTION OF THE ILLUSTRATED EMBODIMENT

Figure 2:
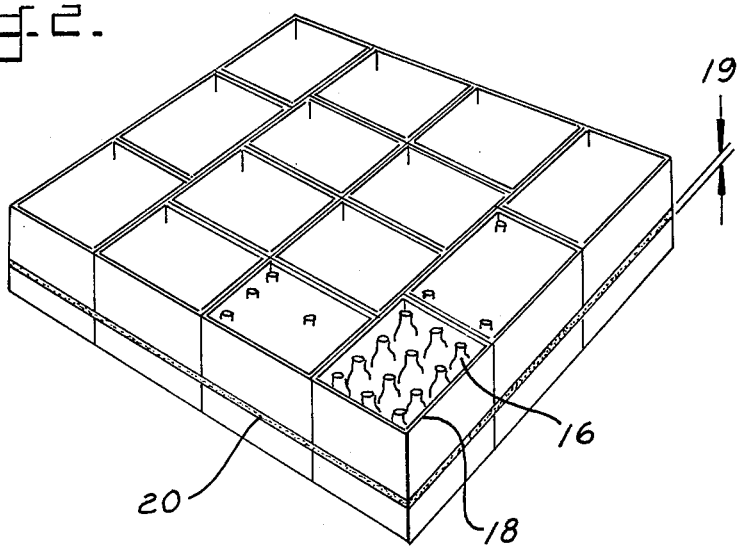
FIG. 2 is a three-dimensional view of an embodiment of the lower layer of the improved load of the invention.
Figure 3:
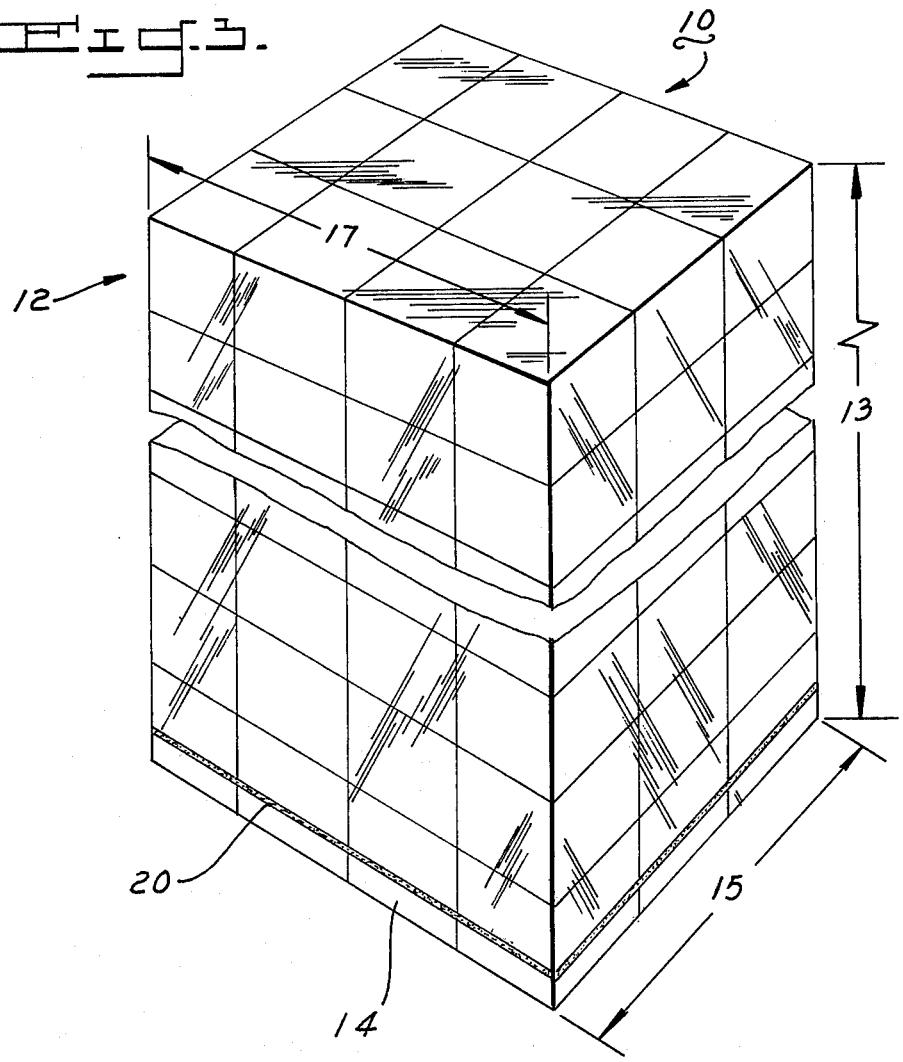
FIG. 3 is a three-dimensional view of a full load unit embodying the invention.

Referring now to the drawings, there is illustrated in FIG. 3, a palletless load unit, generally indicated as 10, which includes a series of rectangularly arranged and vertically stacked layers individually identified as 12, with each layer containing a plurality of contiguous articles 14 disposed in side-by-side relationship. Each layer comprises a plurality of rows, each row including plural articles 14, and extending lengthwise of either load dimension 15 or 17, with long and short sides of articles 14 in any given row randomly abutting each other. The number of articles 14 in an individual layer 12 can vary from the fourteen shown in FIG. 2, and for the type of article 14 about to be described, such number should be from about ten to about 20 per layer to facilitate economical handling at high speeds with conventional lift truck equipment. Load unit 10 in the illustrated embodiment has a generally rectangular overall shape though alternative contours such as circular, hexagonal, octagonal and the like can be used. Though the number of layers 12 in load unit 10 may vary, usually depending on customer, economic and stability considerations, heighth 13 (FIG. 3) for most practical applications preferably exceeds both width 15 and length 17 dimensions of any single layer 12.

Each individual articles 14 in the illustrated embodiment exemplarily comprises a corrugated cardboard box (FIG. 2) having four planar sides and containing plural rows of containers 16 seated in case lot quantities therein below the horizontal plane of upper sidewall edge 18. Containers 16 are in the form of empty lightweight, plastic, narrow-neck bottles having a weight range of between about 0.03 to 0.13 grams per cubic centimeter of internal volume.

In accordance with the invention, strapping means comprising a relatively thin flexible metal band 20, locally circumscribes and compressively engages or grips the outer boxed 14 in the closed perimeter of the lowermost layer of load unit 10 for the purpose of unitizing and rendering such lowermost layer suitable as the integral support means per se for the rest of the load. Member 20 exerts a unidirectional, lateral compressive force with respect to the vertical height of the load, and snugly secures or captively locks articles 14 together as a result of such compressive force. Though the nature of strap member 20 may vary, it is vertically narrow and well short of the height of the articles 14 which it engages, for example on the order of about ⅛ to 1 inch. Non-metallic, for example plastic, straps, fabric belts, rope and the like may alternately be used in place of metal band 20. The tension extent in strap member 20 likewise can vary depending on the nature of the articles being packaged, and is preferably between about 5 to 50 pounds when dealing with the carbon-enclosed lightweight plastic bottles of the embodiment, since at forces below about five pounds, articles 14 cannot be adequately held together to provide the rigidifying characteristic to the lower layer, whereas at tensions greater than about 50 pounds, the corners of the cartons and, to a certain extent the relatively fragile bottle contents, tend to be crushed. Though the pressure exerted by load 10 can vary depending on the nature of the load, with the articles 14 of the embodiment, such pressure ranges between about 15 to about 150 pounds per square foot. When dimension 13 is about 8 feet and each layer 12 comprises 14 filled boxes as illustrated in FIG. 2, such pressure is about 100 pounds per square foot.

Figure 1:
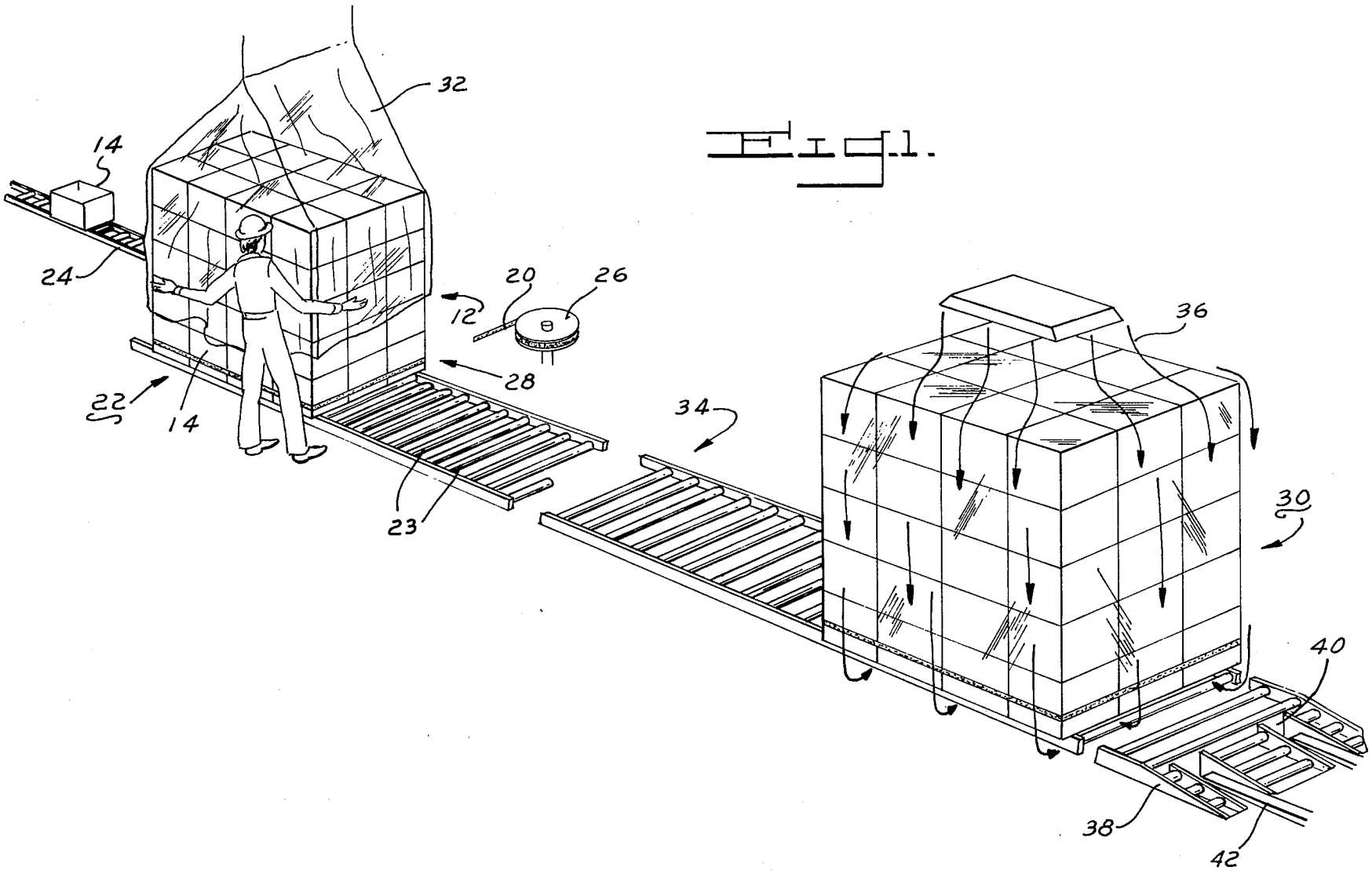
FIG. 1 is a schematic view of a process embodiment of the invention.

Referring now to FIG. 1, an environment is depicted wherein the invention is especially adapted for use. Boxes 14, previously filled with bottles 16 in an upstream station, not shown, are presented via supply conveyor 24 to stacking station 22 where they are collected and arranged in individual superposed horizontal layers 12 either manually, as indicated, or automatically via conventional equipment, not shown. After assembly of a load, the bottom faces of the boxes of one layer may rest atop next lower layer, though a segregating sheet may, if desired, be inserted between layers. In the illustrated embodiment, boxes 14 are open-topped such that the outer surface of the bottom panel of one layer resits on the upper ends of the bottles 16 (FIG. 3) in the boxes of the next lower layer. The interface between immediately adjacent layers in the embodiment illustrated is considered to be substantially planar in extent. No separate load support is provided in station 22, other than temporarily resting the lower layer directly on conveyor rollers 23.

After a load of the desired width, length and height has been assembled in station 22, strap portion 20 is unwound from reel 26 and removably applied tightly in conventional manner, either manually or automatically, around the girth of lowermost layer 28 by conventional means such as a suitable tensioning device, thereby forcefully urging articles 14 into abutting engagement and establishing lowermost layer 28 as the unitized support for the remainder of the load during transfer movement between stacking station 22 and adjacent load-unitizing station 30. For example, strap 20 in the form of a steel band may be applied around layer 28, then severed from the remainder on reel 28 to form a periphery-spanning portion, and the two ends then urged together with a suitable lever mechanism, not shown, to establish the required load-unitizing tension, after which a tool die is used to secure the loose ends together, for example by means of a mechanical clip, not shown. A suitable exemplary mechanism for applying such a band is commercially available from Stanley Strapping Systems, New Britain, Conn.

In the embodiment illustrated wherein bottles 16 are the objects within cartons 14, some void space will exist between the inside surface of the carton panels adjacent their upper ends and the outer surface of the reduced diameter neck portions of the bottles when the latter are seated in rows in cartons 14 in the manner shown in FIG. 2. Under such conditions strap 20 should be applied, as shown, around the lower portion of the cartons where the support of the large diameter portion of the bottle body exists against the inner panel surface in order to prevent carton collapse which could otherwise occur if strap 20 were applied adjacent the interiorly unsupported upper ends of the carton panels.

A conventional thin, heat shrinkable open-bottom plastic bag 32 made, for example, of thermoplastic material such as polyethylene film of about 0.001 to 0.015 inch thickness, is then very loosely draped over the load and the package urged forwardly on conveyor rollers 23 to load-unitizing downstream station 30, either via gravity through the tilt of transfer conveyor 34 or by powering rollers 23 through driving contact with moving belts situated beneath such roller, not shown. Alternately, bag 32 could be applied over the load after such movement and just prior to entering station 30. In any event, during such forward transfer movement of the load to the adjacent downstream station 30, the load remains intact with integrity maintained via the support provided by unitized lower layer 28, thus avoiding the need for a separate support member such as a pallet, slip sheet or other device heretofore used. At this point, i.e. prior to full-load unitizing, those layers 12 above lower layer 28 in the illustrated embodiment are substantially free of restraining means or captive confinement, strap 20 being the only effective means of holding the load together other than the weight of the articles per se in those layers above the lower one.

Upon arrival at station 30, the load is exposed to forced hot ir, schematically indicated via arrows 36, issuing from a suitable supply source so as to shrink the envelope 32 into tight sealing engagement with the load with strapping member 20 preferably still in place, (though it could be removed, depending on the nature of the load, prior to shrinking the envelope into place) thereby forming the fully unitized load 10 of FIG. 3. If desired, the load may be elevated a few feet in station 30 in conventional manner during shrinking of the film overwrap, for example via a platform acting within the four corners and against the underside of the bottom layer, not shown, to facilitate shrinking the film under the lower layer, especially at the corners, thereby enhancing the rigidity of the total load.

Thereafter, load 10 is urged forwardly on conveyor portion 38 which may, for example, be provided with slots 40 to accomodate insertion of tines 42 of a conventional fork truck, not shown, beneath the lower unitized layer to permit elevation and transportation to storage or shipment directly to a customer. In transferring the fully unitized load 10 to the fork truck, it may be necessary to position tines 42 in a predetermined location with respect to the layout pattern of boxes in the lower layer in order to avoid leaving one or more boxes in the middle of the lower layer unsupported. This will depend on the number of articles in the layer, the configuration of the layer pattern and the surface area of the tines and can be readily determined experimentally.

Depending on the nature of the layered articles, the load unit of the invention may be stored and/or shipped without further unitizing beyond the presence of a strap member around the lower layer to create the intended support. For example, when articles 14 are relatively heavy with weight per se of an individual article may be adequate to hold it in place in the load above the captively held lower layer. Also, alternative means of uniting the layers above the lower one can be used in place of the heat shrunk film. For example, plural straps extending around the load in the vertical direction can be used to hold relatively light layers vertically against each other; or adjacent layer faces can be adhesively secured together. Peripheral banding of one or more upper layers is also optionally feasible to prevent individual articles from falling off during load movement. It is critically necessary, however, that compressive strapping at least around the full extent of the closed periphery of the lower layer in order to establish the articles of such lower layer, whatever their configuration may be, as the support for the palletless load unit in accordance with the invention.

While it will be apparent that the preferred embodiment of the invention herein disclosed is well calculated to fulfill the objects above stated, it will be appreciated that the invention is susceptible to modification, variation and change.

What is claimed is:

1. In a palletless load unit which includes:

vertically stacked layers containing plural articles comprising lightweight plastic containers, each having a weight range of from about 0.03 to 0.13 grams per cubic centimeter of internal volume, said load unit exerting a pressure of between about 15 to 150 pounds per square foot, the improvement which includes:

strapping means locally perimetrically disposed around the vertical side walls of the lowermost layer and compressively engaging outer articles therein at a force of between about 5 to 50 pounds to unitize such outermost layer, said strapping means being vertically narrow having a height substantially less than that of said articles in said lowermost layer and except for the weight of the upper layers, said lowermost layers being unrestrained from movement in the vertical direction.

2. The unit of claim 1 wherein said articles include cartons, each of which contains plural rows of said lightweight plastic containers.

3. The unit of claim 1 wherein the height of the load unit exceeds both the length and width of any individual layer.

4. The unit of claim 1 wherein layers above the lowermost layer are substantially unrestrained, except for gravity, from either horizontal or vertical movement.

* * * * *